US012642325B2

(12) United States Patent
Ostergard

(10) Patent No.: US 12,642,325 B2
(45) Date of Patent: Jun. 2, 2026

(54) PROTECTIVE HELMET

(71) Applicant: Doak Ostergard, Lincoln, NE (US)

(72) Inventor: Doak Ostergard, Lincoln, NE (US)

( * ) Notice: Subject to any disclaimer, the term of this patent is extended or adjusted under 35 U.S.C. 154(b) by 0 days.

(21) Appl. No.: 16/582,665

(22) Filed: Sep. 25, 2019

(65) Prior Publication Data

US 2021/0022429 A1 Jan. 28, 2021

Related U.S. Application Data

(60) Provisional application No. 62/879,352, filed on Jul. 26, 2019.

(51) Int. Cl.
*A42B 3/06* (2006.01)

(52) U.S. Cl.
CPC ..... *A42B 3/06* (2013.01)

(58) Field of Classification Search
CPC ..... A42B 3/06; A42B 3/0479; A42B 3/10; A42B 3/22; F16F 7/121; A43B 3/06
USPC ..... 2/411
See application file for complete search history.

(56) References Cited

U.S. PATENT DOCUMENTS 3,716,048 A * 2/1973 Alonso ..... A61H 7/006 601/95
5,129,107 A * 7/1992 Lorenzo ..... A42B 1/203 2/413
5,204,998 A * 4/1993 Liu ..... F16F 1/3732 2/411
5,475,937 A * 12/1995 Korsen ..... A43B 3/0042 36/134
5,561,866 A * 10/1996 Ross ..... A42B 3/065 2/410
5,687,426 A * 11/1997 Sperber ..... A42B 3/061 2/411
5,806,889 A * 9/1998 Suzuki ..... B60R 21/04 280/748
5,853,844 A * 12/1998 Wen ..... A43B 13/181 428/119
5,915,819 A * 6/1999 Gooding ..... A43B 19/00 36/29
5,956,777 A * 9/1999 Popovich ..... A42B 3/065 2/424
5,958,551 A * 9/1999 Garcia-Ochoa ..... B32B 3/10 428/137

(Continued)

*Primary Examiner* — Alissa J Tompkins
*Assistant Examiner* — Catherine M Ferreira
(74) *Attorney, Agent, or Firm* — Suiter Swantz IP

(57) ABSTRACT

A safety helmet, for example, usable in sports such as football, is shown and described. The safety helmet includes an outer shell and an inner shell. The latter encircles a head of a wearer of the safety helmet. The outer shell is coupled in spaced apart relation to the inner shell by impact attenuators that include in one variation elastically deformable pins. The pins protrude through the inner shell to the inner head seating structure, and outside the inner shell to the outer shell. In another version of the impact attenuators, the pins are bound to a lattice construction providing openings further accommodating deformation responsive to impact forces. Inner and outer shells may have holes to accept ends of the pins. The number of holes may exceed those actually occupied by ends of pins, thereby providing adjustability in number and location of either version of impact attenuator.

5 Claims, 4 Drawing Sheets

(56) References Cited

U.S. PATENT DOCUMENTS 6,415,467 B1 * 7/2002 Bretvin ..... A47C 4/54 5/710
6,682,128 B2 * 1/2004 Carroll, III ..... A62B 1/22 296/187.03
6,777,062 B2 * 8/2004 Skaja ..... B32B 3/26 428/143
7,052,077 B1 * 5/2006 Kalageros ..... B62D 21/15 296/191
7,493,708 B2 * 2/2009 Crowley, Jr. ..... A43B 13/181 36/103
7,673,351 B2 * 3/2010 Copeland ..... A42B 3/124 2/425
8,499,366 B2 * 8/2013 Nimmons ..... A42B 3/20 2/425
8,955,169 B2 * 2/2015 Weber ..... A42B 3/064 2/411
9,763,487 B1 * 9/2017 Brown, Jr. ..... A42B 3/121
9,839,251 B2 * 12/2017 Pannikottu ..... A42B 3/125
9,890,827 B2 * 2/2018 Schaedler ..... B60N 3/048
10,098,406 B2 * 10/2018 Erb ..... A42B 3/127
10,244,809 B2 * 4/2019 Linares ..... A42B 3/064
10,271,605 B2 * 4/2019 Withnall ..... A42B 3/08
10,349,697 B2 * 7/2019 Morgan ..... A42B 3/128
10,376,000 B2 * 8/2019 Desnoyers ..... A63B 71/08
10,544,849 B2 * 1/2020 Lamson ..... F16F 1/3732
10,588,372 B2 * 3/2020 Ho ..... A42B 3/12
10,618,246 B2 * 4/2020 Parsons ..... B32B 7/05
10,729,200 B2 * 8/2020 Sicking ..... A42B 3/046
10,791,785 B2 * 10/2020 Kuntz ..... A42B 3/0486
10,806,203 B2 * 10/2020 Grice ..... A42B 3/06
10,813,402 B2 * 10/2020 Posner ..... A42B 3/064
2004/0218860 A1 * 11/2004 Koh ..... G02B 6/124 385/37
2006/0075693 A1 * 4/2006 Tsunoda ..... B31D 3/0207 52/80.1
2009/0272612 A1 * 11/2009 Cho ..... B60R 21/0428 188/377
2009/0293165 A1 * 12/2009 Arnold ..... A42B 3/226 2/15
2010/0186150 A1 * 7/2010 Ferrara ..... F16F 9/0481 2/412
2010/0299812 A1 * 12/2010 Maddux ..... A41D 13/0156 2/414
2011/0283873 A1 * 11/2011 Wadley ..... B32B 5/02 89/36.02
2012/0017358 A1 * 1/2012 Princip ..... A42B 3/20 2/414
2013/0014313 A1 * 1/2013 Erb ..... A42B 3/122 2/410
2013/0333098 A1 * 12/2013 Nimmons ..... A42B 3/16 2/414
2014/0007322 A1 * 1/2014 Marz ..... A42B 3/065 2/411
2014/0208486 A1 * 7/2014 Krueger ..... A42B 3/064 2/414
2015/0164172 A1 * 6/2015 Linares ..... A42B 3/0473 2/411
2015/0223545 A1 * 8/2015 Fraser ..... B29C 69/00 2/413
2015/0230537 A1 * 8/2015 Warmouth ..... A42B 3/127 2/414
2015/0359285 A1 * 12/2015 Rennaker, II ..... A42B 3/064 2/414
2016/0018278 A1 * 1/2016 Jeter, II ..... G16H 40/67 340/665
2016/0021965 A1 * 1/2016 Mayerovitch ..... A42B 3/064 2/414
2016/0160952 A1 * 6/2016 Schaedler ..... B60N 3/048 188/377
2017/0303622 A1 * 10/2017 Stone ..... A42B 3/064
2017/0303623 A1 * 10/2017 Sicking ..... A63B 71/10
2017/0347739 A1 * 12/2017 Linares ..... A42B 3/064
2018/0035740 A1 * 2/2018 Knight ..... A42B 3/121
2018/0295922 A1 * 10/2018 Princip ..... A42B 3/063
2019/0029352 A1 * 1/2019 Sadegh ..... A42B 3/06
2019/0069623 A1 * 3/2019 Kuntz ..... A42B 3/0473
2019/0116907 A1 * 4/2019 Grice ..... F16F 1/371
2019/0383346 A1 * 12/2019 Clayton ..... F41H 1/02
2020/0008510 A1 * 1/2020 Garneau ..... A42B 3/12
2020/0022444 A1 * 1/2020 Stone ..... A42B 3/062
2020/0029644 A1 * 1/2020 Kele ..... A42B 3/064
2020/0121015 A1 * 4/2020 Ku ..... A42B 3/12
2021/0000209 A1 * 1/2021 Neubauer ..... A42B 3/063
2021/0007432 A1 * 1/2021 Santiago ..... A42C 2/007

* cited by examiner

PROTECTIVE HELMET

CROSS-REFERENCE TO RELATED APPLICATION

This application claims the benefit of priority to US Provisional Utility Application No. 62/879,352, filed Jul. 26, 2019, the contents of which are incorporated by this reference.

FIELD OF THE INVENTION

The present invention relates to helmets, such as sports helmets, for absorbing impacts by internal deflection.

BACKGROUND OF THE INVENTION

A number of sports present hazards to players due to impacts. Impacts may arise from collisions between players as the players run on a game field. Impacts to the head present significant risk of both immediate and latent injuries to the brain. There is therefore a need for a sports helmet which attenuates impact forces to the head of a person wearing the helmet while playing a sport.

SUMMARY OF THE INVENTION

The present invention provides a safety helmet including inner and outer shells A plurality of impact modifiers each including a plurality of deformable pins are located between the outer shell and the inner shell. Ends of the pins are received in holes in the inner shell and holes in the outer shell. The pins of the impact modifiers elastically deform responsive to impacts to the inner or outer shells, thereby providing impact protection superior to conventional sports helmets.

In addition to the pins, the impact modifiers may include a lattice type construction including interstitial spaces so that the impact modifiers accommodate deformation responsive to impacts both by elastic deformability of the constituent material, and also because the interstitial spaces further accommodate temporary displacement and compression of the impact modifiers during impacts to the outer shell and inner shell.

The holes in the inner and outer shells are greater in number than the intended number of pins located on the impact modifiers, so that the impact modifiers can be selectively located as desired.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
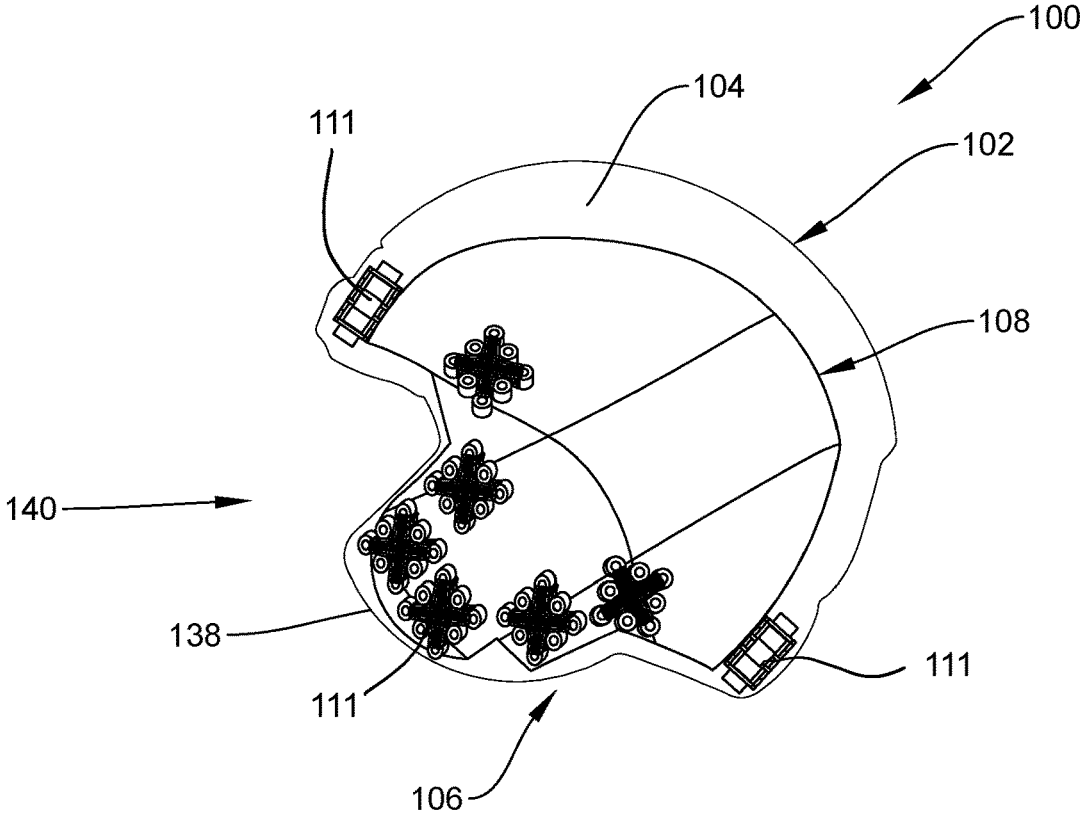
FIG. 1 is a side view of a safety helmet according to the present disclosure, shown in cross section.

Referring to the drawings but particularly to FIG. 1, according to at least one aspect of the invention, there is shown a safety helmet 100 for protecting a person (not shown) from impacts during sports activities. Safety helmet 100 may comprise an outer shell 102, an inner shell 108, and an interior 104 between the outer shell 102 and inner shell 108, and a head opening 106 for inserting a head of the person into the safety helmet 100. Inner shell is configured to engage the head of the person.

Safety helmet 100 includes at least one impact attenuator 111 coupled to the outer shell 102 and to the inner shell 108. The impact attenuator 111 is configured to accommodate desired impact attenuation in a number of ways. Namely, by enabling adjustment of the position of the impact attenuator between the outer shell 102 and the inner shell 108, by varying the composition of the impact attenuator (for example, using more flexible versus more less flexible polymers), and also by resilient deformation of the impact attenuator 111.

Figure 2:
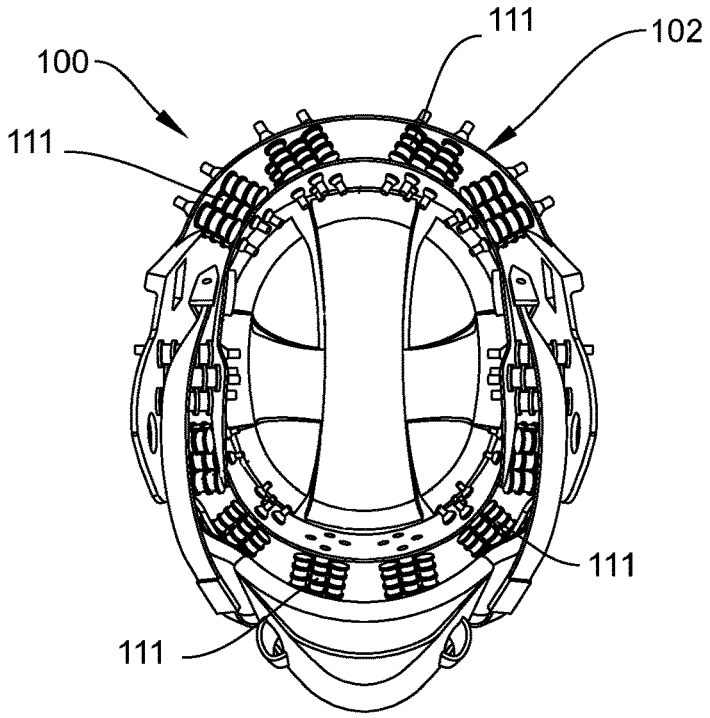
FIG. 2 is a bottom plan view of the safety helmet of FIG. 1.
Figure 3:
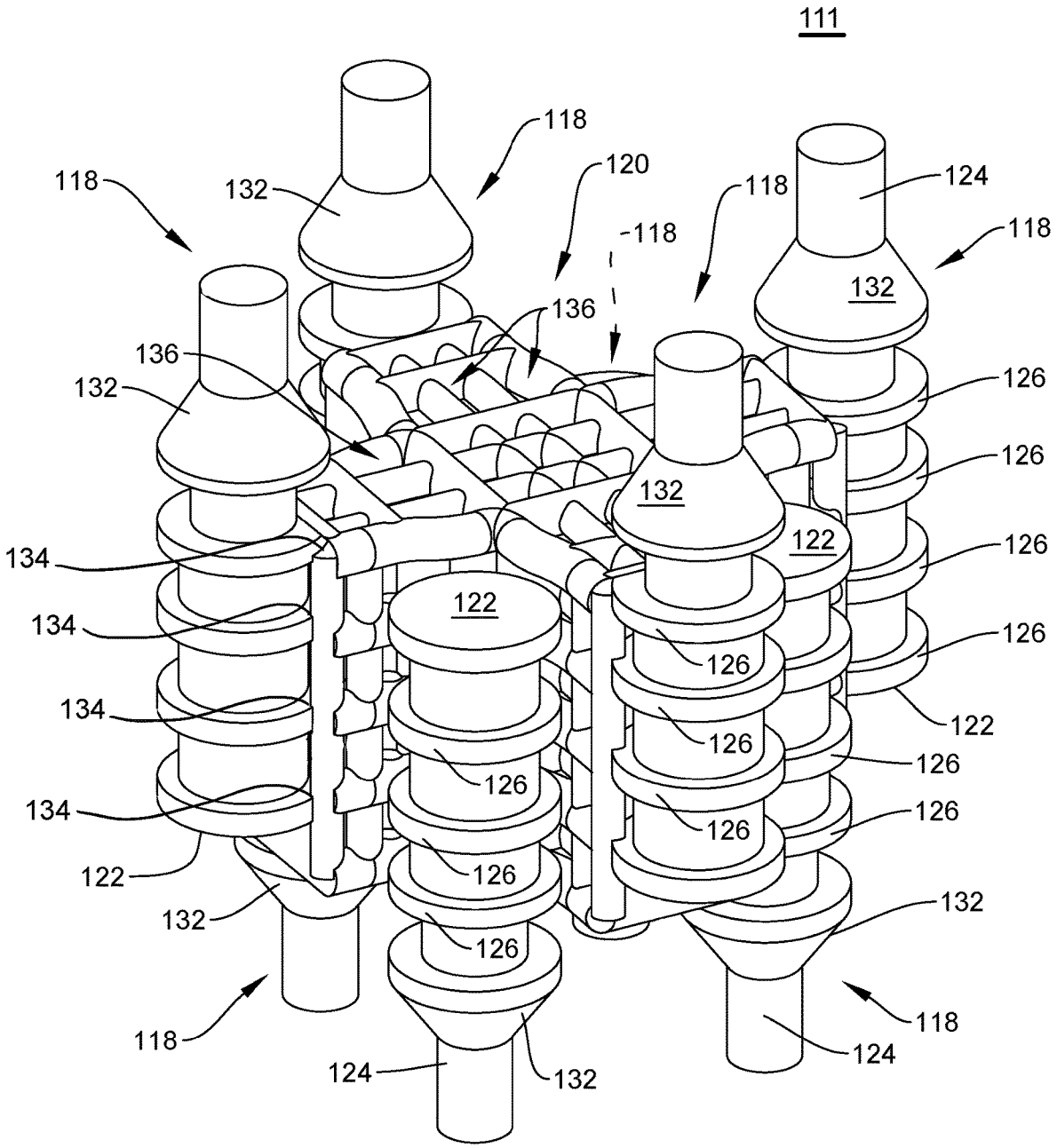
FIG. 3 is a perspective detail view of one of the components shown distributed about the periphery of the safety helmet in FIG. 2, with FIG. 3 drawn to enlarged scale.
Figure 5:
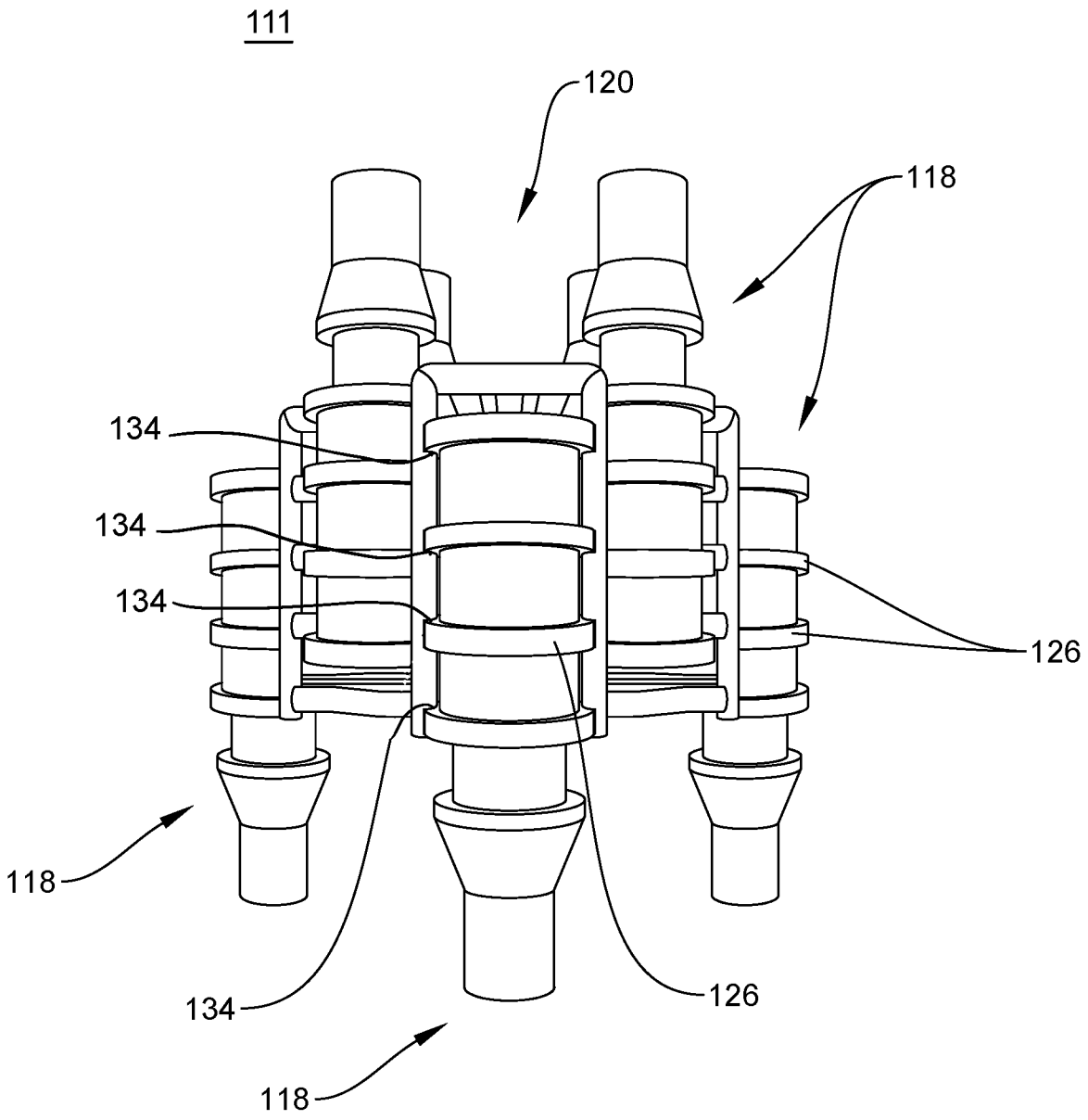
FIG. 5 is an enlarged side detail view of the component shown distributed about the periphery of the safety helmet in FIG. 2.

Looking more closely at the impact attenuator 111 structure itself, the impact attenuator 111 includes a plurality of resilient pins 118 and a stabilizer 120 that partially contacts each one of pins 118. Stabilizer 120 contacts each pin 118 and opposes axial motion of the pins 118 contacted thereby when outer shell 102 or inner shell 108 is subjected to an impact. One impact attenuator 111 is shown in FIGS. 3 and 5. Several impact attenuators 111 are shown in FIG. 2.

As mentioned above, impact attenuators 111 may have a first flexibility characteristic and other impact attenuators 111 may have a second flexibility characteristic. This feature allows impact attenuators 111 in some locations on safety helmet 100 to provide one level of resistance to deformation, and other impact attenuators 111 to provide a different level of resistance to deformation. Differences in flexibility may be present in pins 118, in the stabilizer 120, or in both.

Impact attenuators 111 may be fabricated by molding, by three dimensional printing, or in other ways.

In summary, inner and outer shells 108, 102 are generally concentric. The inner and outer shells 108, 102 are not rigidly held in concentric or centered positions. Rather, they float in that they can move within limited ranges as impacts move and deform the flexible impact attenuators 111.

Referring also to FIG. 3, each pin 118 of impact attenuator 111 may comprise a flat stub end 122, an opposed protrusion end 124, and a plurality of outwardly projecting flanges 126 between the flat stub end 122 and the protrusion end 124. The outwardly projecting flanges 126 bind that portion of the pins 118 to the stabilizer 120.

Figure 4:
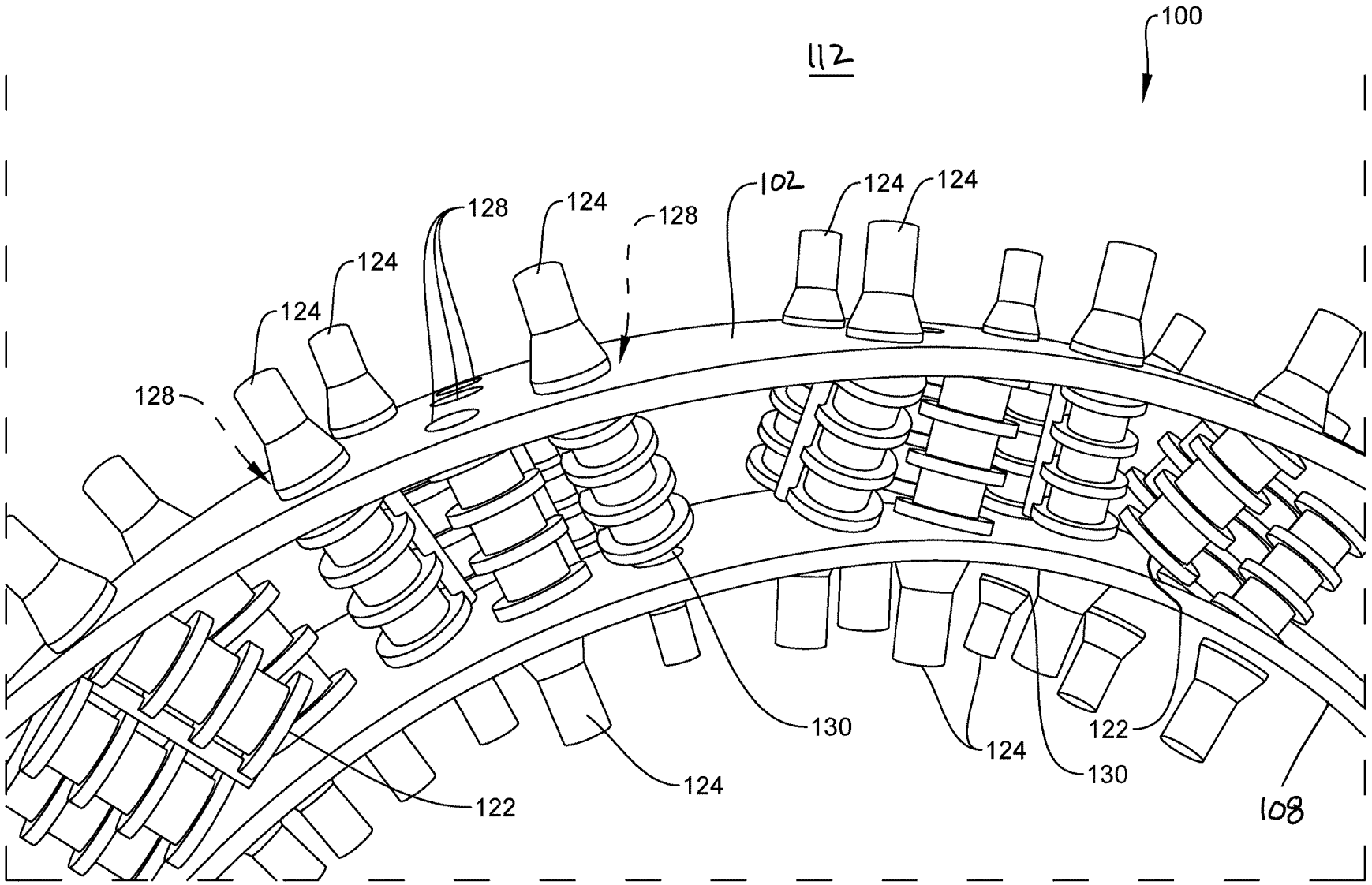
FIG. 4 is a perspective detail view of the safety helmet of FIG. 1, shown in cross section and to enlarged scale.

FIG. 4 provides an alternative embodiment of an impact attenuator 112. In this embodiment, individual pins 118 not bound to a stabilizer 120. As seen in FIG. 4, the outer shell 102 includes a plurality of holes 128 each dimensioned and configured to receive one protrusion end 124 of each pin 118. Likewise, inner shell 102 includes a plurality of holes 130 each dimensioned and configured to receive protrusion end 124 of each pin 118. Holes 128 of outer shell 102 and holes 130 of inner shell 108 are positioned in such a way so that a plurality of pins 118 spanning outer shell 102 and inner shell 108 act to create an interior 104 and act to support the outer shell 102 and inner shell 108 in spaced apart relation and allow for the outer and inner shell to move independent of each other to a limited degree. This benefit is the same when either the individual pins 118 are used or when they are connected to a stabilizer 120.

Each protrusion end 124 of pin 118 includes a tapered head 132. Because pins 118 are made from a resilient material, tapered heads 132 can be deformed to fit into holes 128 and 130 of the outer and inner shells. Once a tapered head 132 has passed through a hole 128 or 132, it resiliently expands to oppose spontaneous movement and consequent potential loss through the hole 128 or 132.

As seen in the detail of FIGS. 3 and 5, each stabilizer 120 comprises a plurality of seats 134 recessed into stabilizer 120. Each seat 134 may be dimensioned and configured to receive one of flanges 126 and to constrain flange 126 against lateral motion and against travel in axial motion. Seats 134 can be seen as grooves but are best shown in the figures as molded attachment points between the pin 118 flanges 126 and the stabilizer 120. It should be noted that when the impact attenuator is properly mounted to connect the inner shell 102 and the outer shell 108, pins 118 can be moved along their length, with flanges 126 resiliently yielding to accommodate such motion. The constituent material of pins 118 are sufficiently rigid as to oppose unintended motion.

Referring again to FIG. 3, each stabilizer 120 includes openings 136 projecting into stabilizer 120 to accommodate elastic deformation of stabilizer 120 when subjected to an impact to safety helmet 100. Each stabilizer 120 may comprise a lattice structure, and openings 136 projecting into stabilizer 120 alternate with solid members of the lattice structure. For the purposes of the present disclosure, a lattice structure is a structure formed from intersecting elongated members such as rods, wherein the elongated members are fused together at intersections. In a lattice, elongated members are sufficiently spaced apart as to leave interstitial openings 136. These openings 136 provide space to accommodate displaced constituent material of the elongated members and of pins 118, as may occur when safety helmet 100 is subjected to impacts.

Each stabilizer 120 may be configured to engage up to eight pins 118. Noting from FIG. 3 that pins 118 may face in opposed directions, each stabilizer can thus accommodate four pins 118 facing in each of two opposed directions. Four pins 118 may have projection ends 124 facing in one direction, so as to be able to penetrate holes 128 or 130, with another four pins 118 presenting relatively large flat stub ends 122 for abutment against a surface of outer shell 102, inner shell 108 only when either surface is under impact to drive the inner and outer shells together. At rest, and as seen in FIG. 4, there is space between the flat stub ends 122 and the inner and outer shell surfaces. This helps provide the safety helmet 111 with a bit of travel distance or give before the full support and contact surfaces of the impact attenuator 111 are engaged upon a certain level of impact. Projection ends 124 may be severed or trimmed where projecting through holes in outer shell 102, or if desired, through holes within safety helmet 100.

Safety helmet 100 is primarily intended for protection to sports athletes, although use in other applications such as factories, mines, and construction is possible. In sports applications, inner shell 108 may cover a crown of the head, right and left sides of the head, and a rear of the head of the person (not shown) wearing safety helmet 100. This configuration is typical for many sports, such as football. For football and similar sports, safety helmet 100 may include a face guard 138 (see FIG. 1) coupled to safety helmet 100 and projecting to a front of face opening 140 (see FIG. 1).

Safety helmet 100 may incorporate features known in or conventional with sports helmets, even if not so described and shown herein. For example, safety helmet 100 may include ear openings (not shown) to facilitate hearing, and an eye visor or full face visor (neither shown) in front of safety helmet, in the manner for example of known helmets used in football. Also, padding and additional cushioning may be provided as desired. The present invention is susceptible to modifications and variations which may be introduced thereto without departing from the inventive concepts. For example, pins 118 may be utilized without stabilizers 120 by having projection and flat stub ends 124, 122 received in corresponding holes (e.g., holes 128 or 130) in inner or outer shells 108 or 102, and in head seating structure 114, for example.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A safety helmet for protecting a person from impacts during sports activities, the safety helmet comprising:

an outer shell;

an inner shell, the inner shell having an interior and a head opening configured for inserting a head of the person into the interior of the inner shell; and a plurality of impact attenuators coupled to said inner shell and to said outer shell, such that the plurality of impact attenuators support the outer shell and the inner shell in spaced apart relation, wherein each impact attenuator of the plurality of impact attenuators comprises:

a plurality of resilient pins that include a protrusion end and an opposed flat stub end; and a stabilizer coupled to each of said plurality of said resilient pins, the stabilizer including a lattice structure with multiple rows of intersecting elongated members in a stack between the inner shell and the outer shell and multiple columns of intersecting elongated members, the multiple columns of intersecting elongated members are coupled to the multiple rows of intersecting elongated members at intersections, the multiple rows of intersecting elongated members and the multiple columns of intersecting elongated members are spaced apart to leave interstitial openings between the multiple rows of intersecting elongated members and the multiple columns of intersecting elongated members, wherein the plurality of impact attenuators are configured to accommodate impacts by enabling adjustment of a position of at least one of the impact attenuators about a surface of the outer shell and a surface of the inner shell.

2. The safety helmet of claim 1, wherein said plurality of resilient pins of said impact attenuators further comprise at least one outwardly projecting flange between the protrusion end and the opposed flat stub end and wherein said stabilizer is coupled to said pins at the at least one of said outwardly projecting flanges.

3. The safety helmet of claim 1, wherein the interstitial openings of the stabilizer are configured to accommodate elastic deformation of the stabilizer when subjected to an impact to the safety helmet.

4. The safety helmet of claim 1, wherein each said stabilizer is configured to engage up to eight said resilient pins.

5. The safety helmet of claim 1, wherein some of the plurality of impact attenuators have a first flexibility characteristic and others of the impact attenuators having a second flexibility characteristic.

* * * * *